United States Patent [19]

Bonerb

[11] Patent Number: 4,583,663

[45] Date of Patent: Apr. 22, 1986

[54] VALVE ASSEMBLY AND AUTOMATIC CONTROL SYSTEM FOR MATERIAL HANDLING AND STORAGE BIN

[75] Inventor: Timothy C. Bonerb, Orchard Park, N.Y.

[73] Assignee: Vincent C. Bonerb, Boston, N.Y. ; a part interest

[21] Appl. No.: 659,248

[22] Filed: Oct. 10, 1984

Related U.S. Application Data

[63] Continuation-in-part of Ser. No. 465,797, Feb. 11, 1983, Pat. No. 4,487,335, and a continuation-in-part of Ser. No. 480,499, Mar. 30, 1983, Pat. No. 4,534,596, and a continuation-in-part of Ser. No. 500,821, Jun. 3, 1983.

[51] Int. Cl.[4] ..... B65D 88/62

[52] U.S. Cl. ..... 222/61; 222/63; 222/136; 222/386.5; 222/396; 222/397; 222/642; 414/304; 414/323; 414/539

[58] Field of Search ..... 222/94, 95, 105, 195, 222/386.5, 52, 53, 57, 59, 61, 66, 63, 64, 638, 639, 642, 389, 396, 397, 399, 545, 136; 414/304, 323, 326, 539; 105/423

[56] References Cited

U.S. PATENT DOCUMENTS

| | | | |
|---|---|---|---|
| 2,792,262 | 5/1957 | Hathorn | 414/304 X |
| 2,931,523 | 4/1960 | Nelligan | 222/386.5 X |
| 2,956,839 | 10/1960 | Hermanns | 222/386.5 |
| 3,128,912 | 4/1964 | Cash | 222/389 X |
| 3,139,998 | 7/1964 | Seaman | 414/539 |
| 3,209,680 | 10/1965 | McGinnis | 222/386.5 X |
| 3,270,921 | 9/1966 | Nadolske et al. | 222/545 X |
| 3,396,762 | 8/1968 | Paton | 222/386.5 X |
| 3,941,258 | 3/1976 | Ide | 222/386.5 X |
| 4,421,250 | 12/1983 | Bonerb et al. | 222/95 |
| 4,449,646 | 5/1984 | Bonerb et al. | 222/95 |
| 4,476,998 | 10/1984 | Bonerb et al. | 222/386.5 X |
| 4,487,335 | 12/1984 | Bonerb | 222/386.5 X |

FOREIGN PATENT DOCUMENTS

| | | | |
|---|---|---|---|
| 2512790 | 3/1983 | France | 222/386.5 |
| WO82/03839 | 11/1982 | PCT Int'l Appl. . | |
| 1144162 | 3/1969 | United Kingdom . | |

*Primary Examiner*—Joseph I. Rolla
*Assistant Examiner*—Kevin P. Shaver
*Attorney, Agent, or Firm*—Bernard, Rothwell & Brown

[57] ABSTRACT

A flowable granular, powder or flake material storage bin of the type having an inflatable generally cup-shaped bag with a blower for inflating and a blower for deflating the bag has a valve assembly of unique construction for controlling high-volume low-pressure flow for inflation and deflation cycles. The cycles themselves may be automatically controlled from sensing units which sense when the bag is fully emptied and fully deflated. The valve assembly may be adapted for the sequential discharge of a plurality of bins which may, for example, be located on a freight vehicle.

36 Claims, 12 Drawing Figures

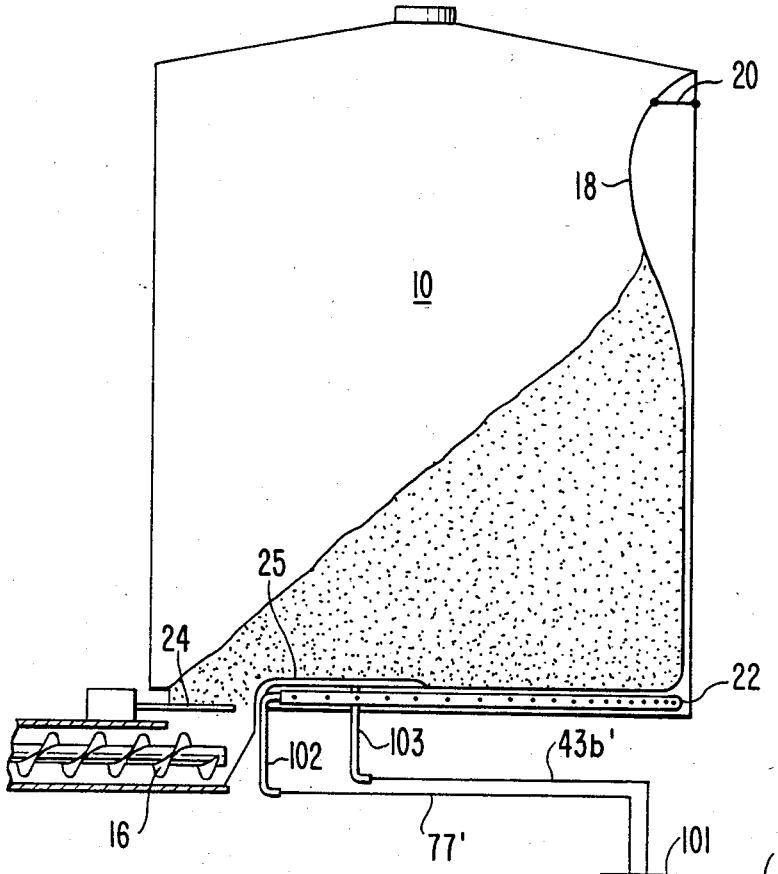
FIG. 5.
FIG. 5A.
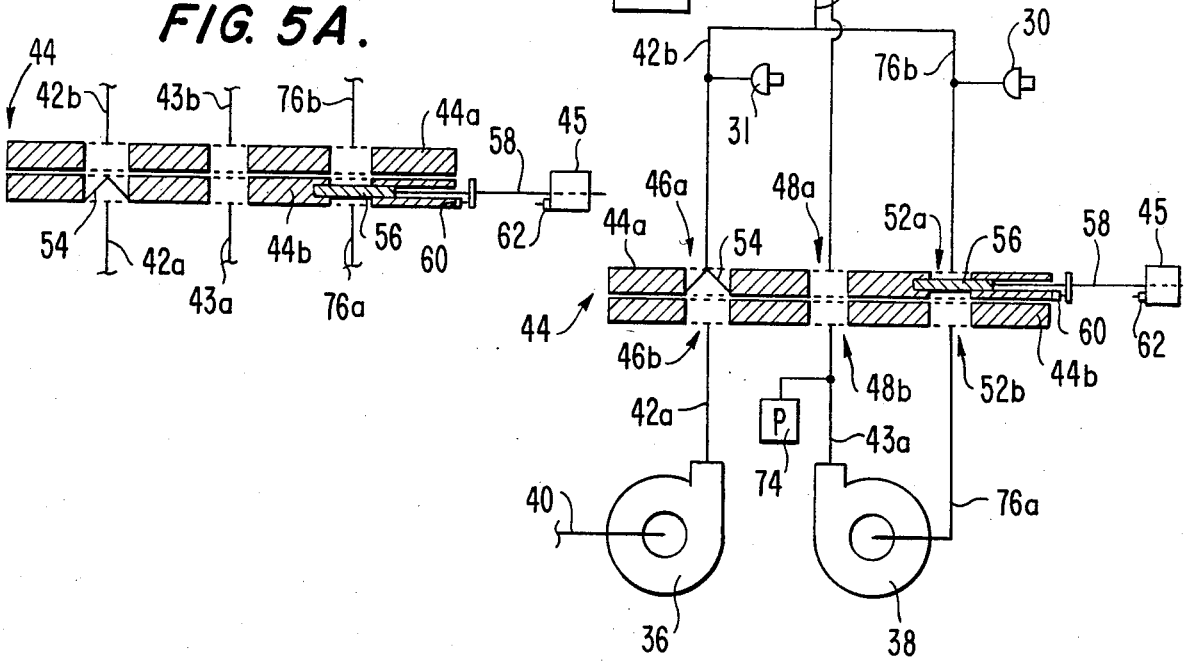

VALVE ASSEMBLY AND AUTOMATIC CONTROL SYSTEM FOR MATERIAL HANDLING AND STORAGE BIN

CROSS REFERENCE TO RELATED APPLICATIONS

This application is a continuation-in-part of copending prior applications, Ser. No. 465,797, filed Feb. 11, 1983, now U.S. Pat. No. 4,487,335; Ser. No. 480,499, filed Mar. 30, 1983, now U.S. Pat. No. 4,534,596; and Ser. No. 500,821, filed June 3, 1983.

BACKGROUND OF THE INVENTION

1. Field of the Invention

This invention relates to improvements in valves and control systems, particularly those adaptable for use in a material handling system of the type utilizing a generally cup-shaped inflatable bag.

2. Description of the Background Art

In commonly owned U.S. Pat. Nos. 4,421,250 and 4,449,646, and copending U.S. patent applications Ser. No. 357,589 filed Mar. 12, 1982, Ser No. 357,592 filed Mar. 12, 1982, now U.S. Pat. No. 4,476,998 and PCT International Publication No. WO82/03839 of Nov. 11, 1982, there are disclosed systems of handling, storing, and discharging bulk material utilizing a generally cup-shaped inflatable bag for assisting in the discharge of material after it stops flowing following discharge to the extent allowed by gravity. In connection with the development of the inventions disclosed in the co-pending applications, it was discovered that there were no suitable valve assemblies and controls needed for controlling the high volume, low pressure air flow required for inflating or deflating the bag.

British Pat. No. 1,144,162 discloses a lined silo in which the liner is expanded by pressure to assist gravity discharge. The fluid pressure control components are shown schematically as a pump, compressor, and three-way valve alternatively connecting the space between the liner and the rigid wall to the pump or compressor. This arrangement has disadvantages in that it lacks automatic controls, lacks means for sensing the end of inflation and deflation cycles and when to turn the system on or off during discharge, and utilizes extra and unneeded components.

There is a need in the art for a relatively high-volume, low-pressure three-conduit fluid flow control valve assembly which can be switched automatically from one cycle to another, i.e., from the inflation cycle to the deflation cycle. It is highy desirable to utilize other than manual controls for changing cycles and to have the valves controlling the conduits through which the inflating and deflating air passes operate quickly and reliably to handle the large volume of low pressure air from a fan, low pressure blower or the like.

SUMMARY OF THE INVENTION

This invention provides a unique valve assembly for controlling high-volume low-pressure air flow through one inlet and two outlet conduits to control inflation and deflation of a cup-shaped bag utilized in the storage and discharge of bulk granular, powdered or flaked material and the like. The valve assembly includes a check valve allowing unidirectional air flow, a passageway allowing bi-directional air flow, and a slide-actuated gate valve operated by suitable drive means, which in turn is automatically controlled. Control means are provided for sensing when the bag is fully emptied of the material being stored to cause the gate valve to reverse and put the system in a deflation mode. Control means may also be provided for controlling gate valve operation and air flow after complete deflation of a bag.

BRIEF DESCRIPTION OF THE DRAWINGS

FIG. 5 is a schematic elevation view of a single bin of the freight vehicle shown in FIG. 2, and controls including the valve assembly of this invention in a material discharging/bag inflating cycle.

FIG. 5A is an alternative embodiment of the valve assembly of FIG. 5.

DETAILED DESCRIPTION OF PREFERRED EMBODIMENTS

Figure 1:
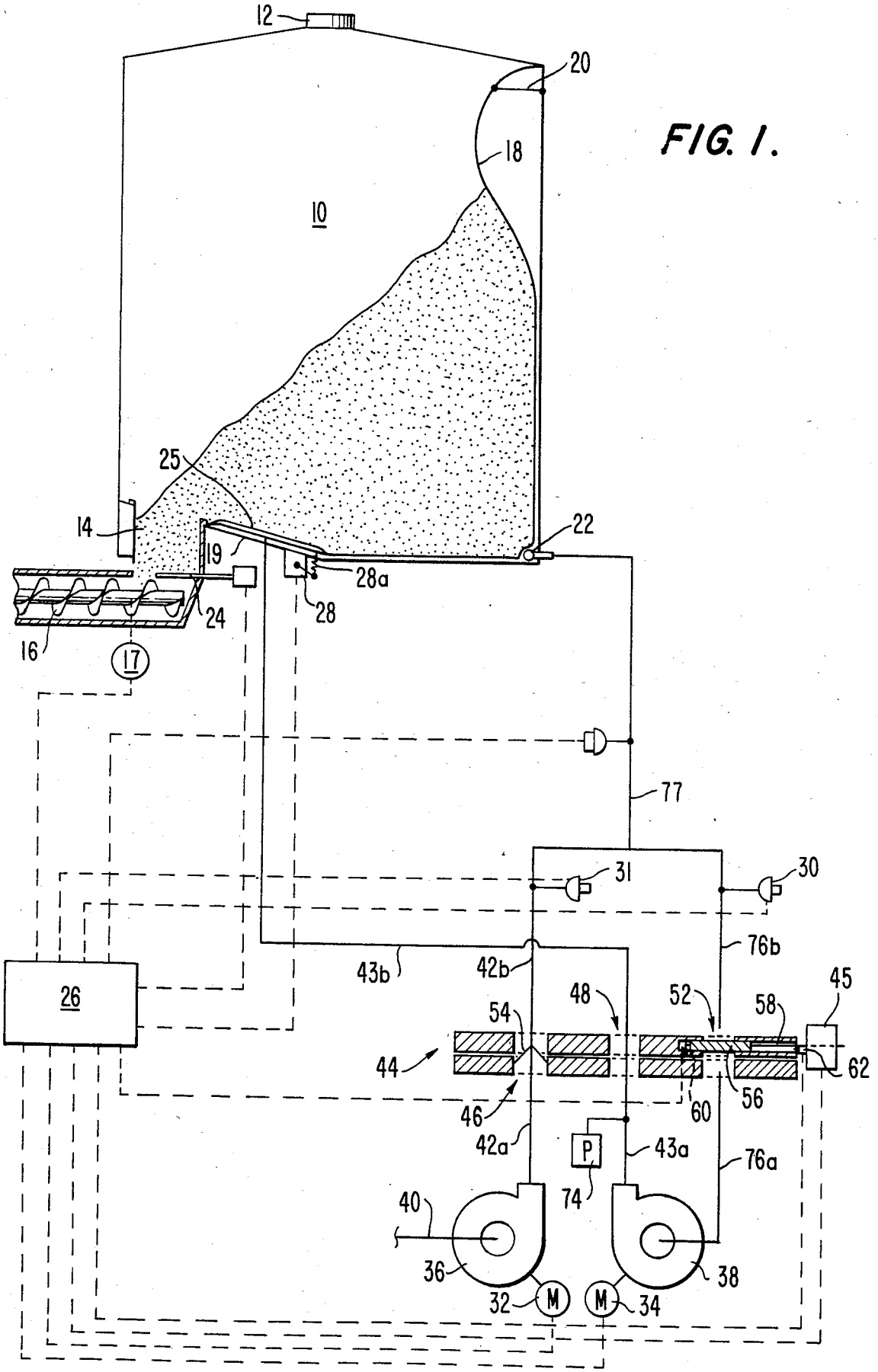
FIG. 1 is a schematic elevation view of a bin having an inclined shelf at the discharge opening, and controls including the valve assembly of this invention in a material-discharging/bag-inflating cycle.

Referring to FIG. 1, and to the commonly owned applications for further details not shown, a material storage bin 10 has a filling opening 12 therein. The bin includes a discharge opening 14 positioned over a discharge conveyor 16. The bin may be provided with a side discharge opening, as illustrated, or a generally centrally located discharge opening as described in commonly owned applications referred to above. The bin may have a generally flat floor, but preferably the floor includes a generally inclined shelf region 19 leading up to a discharge opening 14 elevated above the bin floor, as shown in FIG. 1 and described in commonly owned application Ser. No. 500,821, filed June 3, 1983.

The bin contains a generally cup-shaped, double-walled, inflatable bag 18 as described in greater detail in the commonly owned applications referred to above. Alternatively, the bin may have a rigid, airtight exterior wall, and a single-walled inflatable liner sealed to the rigid exterior wall as disclosed in British Pat. No. 1,144,162.

For creating slack only at the top edge of the bag walls during filling, there is provided one or more flexible bungee cords 20, one of which is shown in FIG. 1. Alternatively, slack may be created during filling by an inflatable collar (not shown) near the top of the bag as described in the commonly assigned applications noted above, or slack may be created by a combination of bungee cords 20 and an inflatable collar. There is also provided a peripherally positioned perforated tube 22 for passing fluid such as air between the walls of the inflatable bag during inflation and deflation.

As described in the aforesaid applications, a bulk material is discharged through the discharge opening 14 to the extent allowed by gravity until the material reaches its angle of repose or stops flowing. Thereafter, as the bag is gradually inflated, its flexible, inflatable inner primary wall bulges starting at the top and nudges more of the bulk material towards the discharge opening. A flexible, inflatable supplemental membrane 25 may also be provided for discharging material remaining in the bag after complete inflation of the primary inner membrane.

The bin is provided with a material sensor 24, which, through control box 26, controls the operation of motor 32 driving low pressure inflation blower 36. The conveyor 16 will continuously convey away material filling discharge opening 14. When there is sufficient material filling the opening the sensor 24 senses the material and through control box 26 turns off the blower 36 so it need not run continuously. However, when a discharge cavity is formed and the sensor 24 senses there is insufficient material to fill the discharge opening 14 the blower 36 is turned on to further inflate the inner wall of the bag, force the inner wall of bag 18 inwardly and nudge more of the material into the discharge cavity and towards the discharge opening 14. A conveyor drive motor 17 is connected to the control box 26 so that when the conveyor 16 is turned off, the entire system is shut off for its protection.

There is one inflation blower 36 shown; however, more than one inflation blower and drive motor may be appropriate depending on the size of the bin. The inflation blower is capable of developing about two pounds-per-square-inch gauge pressure. Typically the pressure required for inflating the bag is about half of this amount. However, the inflation pressure required will vary with the material being handled within the bin and the size of the bag.

The inlet 40 of blower 36 is vented to the atmosphere, and an outlet conduit **42*a* leads from the outlet of blower 36**.

Also shown is a single deflation blower 38, although more than one deflation blower may be appropriate depending on the size of the bin. The deflation blower is generally similar in design to the inflation blower. An inlet conduit **76*a* is connected to the inlet of deflation blower 38 and outlet conduit 43*a* is connected to the outlet of deflation blower 38**.

For controlling the application of air pressure for inflation and deflation of the bag, there is provided a unique valve assembly 44, illustrated schematically in FIG. 1. There are three passages through the valve assembly 44, namely, valve passage 46 for inflation cycle pressure, valve passage 52 for deflation cycle suction, and passage 48 for inflation of the supplemental membrane 25.

Check valve 54 in valve passage 46 permits unidirectional flow of high-volume low-pressure fluid from blower 36 to the bag 18 during the inflation cycle.

Valve gate 56 in valve passage 52 is driven via drive 58 by motor means 45 from control box 26, or other suitable actuator means such as hydraulic, pneumatic or electronic plunger or solenoid means. Valve gate 56 is shown schematically and it is in a closed position during the inflation cycle and open position during the deflation cycle.

Valve gate 56 contacts limit switches 60 and 62 which, through control box 26, control the operation of motor 45. That is, after motor 45 puts valve gate 56 into the closed position (shown in FIG. 1), limit switch 60 will stop motor 45. Similarly, when valve gate 62 is moved to the open position as described below, limit switch 62 operates to control and stop motor 45.

During the inflation cycle in which blower 36 is periodically operated to apply pressure, air under pressure flows through line **42*a*, check valve 54, conduit 42*b*, and common conduit 77 to perforated tube 22 in the double-walled inflatable bag. When sensor 24 turns blower motor 32 off, check valve 54 and closed gate valve 56** prevent deflation of the bag.

Air to supply blower 36 comes from the atmosphere through inlet 40.

Figure 1A:
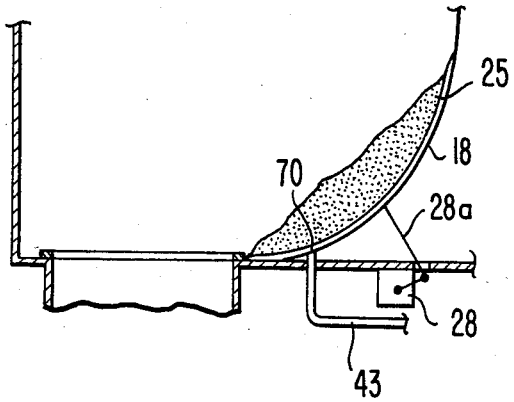
FIG. 1A is a fragmentary schematic partial elevation view of a bin when the primary material discharging/-bag inflating cycle is completed illustrating the sensing of such condition.
Figure 1B:
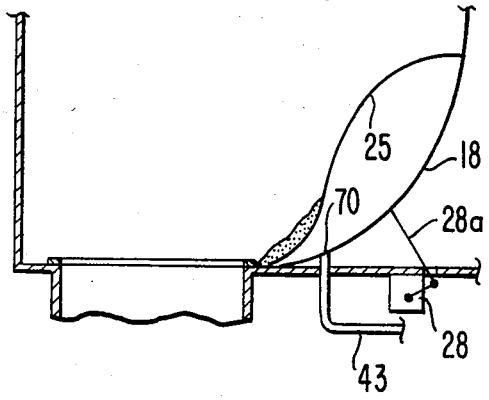
FIG. 1B is a fragmentary schematic partial elevation view of a bin during inflation of the supplemental membrane for discharging material remaining in the bin after inflation of the primary membrane.

The final stages of bin discharge are illustrated in FIGS. 1A and 1B and will now be described. Although FIGS. 1A and 1B illustrate a bin having a generally flat bin floor, the following description of the final discharge stages is equally applicable to bins having an inclined shelf at the discharge opening as illustrated in FIG. 1.

As shown in FIG. 1A, a maximum inflation sensor 28 in the form of a toggle switch has a cord **28*a* connected to it and to the bag wall 18. When the bag 18 is fully inflated at the end of the primary inflation cycle the cord 28*a* operates the sensor switch 28 as shown in FIG. 1A. Blower 36 may be connected to timer means in control box 26 which monitors the duration of continuous operation of the blower. The timer is set to shut blower 36 off if it runs for a period of time, e.g., 30–45 seconds or more, which might overheat the blower, or which indicates discharge obstruction or a broken cord 28*a***.

When sensor switch 28 is operated by cord **28*a*, sensor 28 through control box 26 shuts off blower 36, causes motor 45 to move valve gate 56 to the open position, and starts blower 38** initiating the primary deflation cycle. Alternatively, a mercury switch which monitors the bag wall position could be used in place of the toggle switch and cord.

During the primary deflation cycle, blower 38 blows air through line **43*a*, passage 48, and conduit 43*b*. Air pressure at the end 70 of conduit 43*b* inflates the supplemental membrane 25, discharging material remaining in the bag after inflation of the primary membrane. See FIG. 1B. Positioned in line 43*a* between blower 38 and passage 48 are means for venting to atmosphere excess pressure generated by blower 38 during or after inflation of supplemental membrane 25, such as restrictive vent 74**.

Suction is pulled by blower 38 on suction line **76*a* through valve passage 52, suction conduit 76*b*, common conduit 77 and the perforated bottom peripheral tube 22. This suction pulls a vacuum within the walls of the inflatable bag 18**, and returns it to its original position for receipt of another load of bulk material.

Conduits 42b and 76b can be connected directly to perforated tube 22, and need not be joined at common conduit 77 as illustrated.

As the inflatable bag is returned to its original position, supplemental membrane 25 is flattened, and inflation air therein is forced to atmosphere through line 43 and restrictive outlet 74.

One or more elastic bungee cords 20 and/or an inflatable collar as discussed above, helps create slack near the top of the inner liner to assist in the next discharge cycle after refilling the bin.

When the inner wall 18 of the double-walled inflatable bag is completely returned to its original position, increased vacuum pressure (e.g., 8–15 inches of water pressure) will be sensed on a vacuum sensor 30 and control box 26 will turn off the blower motor 34 and close valve 56 leaving the system at rest. Alternatively, blower motor 34 and valve 56 may be controlled at the end of a deflation cycle by a timer means (not shown) activated at the beginning of a deflation cycle and set to shut off blower motor 34 and close valve 56 at the end of a deflation cycle. Any slack in the wall of the bag 18 will be near its top and the bin ready to be refilled. Slack near the top of the bin prevents tearing of the inner liner during filling, and aids in the initial stages of fluid-assisted discharge.

In addition to the vacuum sensor 30, there is a high-pressure sensor 31. When there is excessive pressure within the walls of the bag, e.g., when there is material blockage, the excess pressure sensor 31 senses this excess pressure and control panel 26 shuts off blower 36 so that it will not keep running when material is not discharging, or develop pressure which might damage the bag 18. High-pressure sensor 31 may be used as an alternative to, or in conjunction with, the blower timer described above for protection of the system. High pressure could also instantly reverse valves to reduce pressure within membrane. Also, the system could go to "reset".

In one embodiment, the valve assembly and control system of the present invention is adapted for discharging bulk material sequentially from a plurality of bins. This embodiment is particularly well suited for sequentially unloading a plurality of such bins carried in a freight vehicle, such as a semi-trailer. The utilization of such bins in a freight vehicle which is convertible from a bulk handling mode to a piece goods handling mode is disclosed in commonly owned, U.S. Pat. No. 4,534,596.

This embodiment of the invention will be described in detail with reference to a freight vehicle having two pairs of inflatable bins, but it is to be understood that the invention is equally applicable to the sequential discharge of any number of stationary or mobile bins of the type above described. Parts which are substantially the same as described in the embodiment depicted in FIG. 1 have the same reference number.

Figure 2:
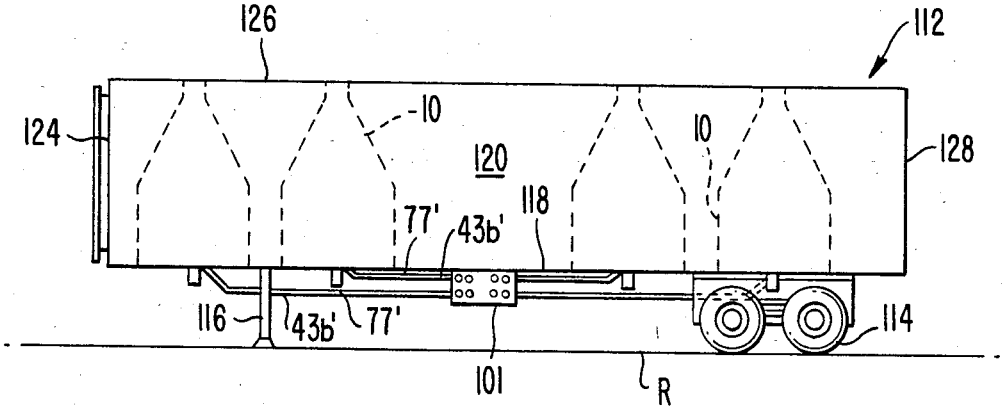
FIG. 2 is a schematic side elevation view of a freight vehicle having four double-walled bag bins and hookups for the valve assembly of the invention.

As shown in FIG. 2, a freight vehicle 112 is in the form of a conventional semi-trailer, although it could be any other cargo-containing space. In the form shown in FIG. 2, the trailer has wheels 114 for movement over a roadway R and a conventional support 116.

The cargo space of the trailer 112 has a conventional flat floor 118, sidewalls 120 and 122, a front-end wall 124, top wall 126, and a rear wall 128 which may conveniently contain access doors as is conventional in such semi-trailers. The trailer thus described is a typical semi-trailer of the type commonly used with trucks to haul piece goods cargo. For converting the trailer cargo space for use for hauling either piece goods or bulk cargo, openings are provided for filling and discharge of bulk material.

The cargo space of trailer 112 can selectively haul bulk cargo in bulk cargo bins 10. As shown in FIG. 2, there are four identical bulk cargo bins which are positioned in pairs, and which are raisable and collapsible from the position for hauling bulk cargo as shown in FIG. 2 to a storage position near top wall 126 so that the cargo space may be used for hauling piece goods.

Each of the bulk cargo bins 10 is a double-walled cup-shaped bag, as described above, with a discharge opening through a sidewall of the freight vehicle 112, or preferably through an opening in the flat floor 118 of the freight vehicle as shown in FIG. 2. Discharge openings in the floor of the trailer may be centrally located for each bin, or located near the side of the freight vehicle as illustrated.

Fill openings for the bags may be provided in a sidewall of the vehicle, but are preferably located in the roof of the vehicle.

Figure 3:
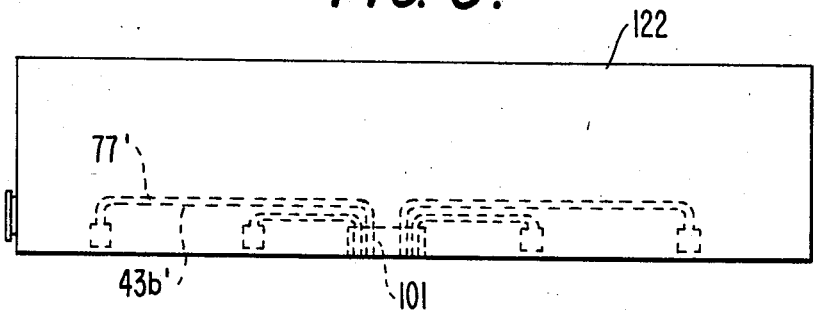
FIG. 3 is a schematic top elevation view of the airway hookups under the floor of the freight vehicle shown in FIG. 2.
Figure 4:
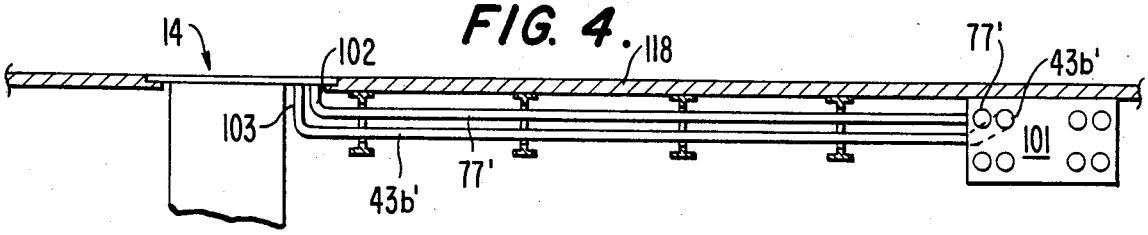
FIG. 4 is a fragmentary schematic partial elevation view of a pair of airways to a single bag under the floor of the freight vehicle shown in FIG. 2.

As shown in FIGS. 2 and 3, a plurality of conduits are connected to the bins 10, each bin being connected to two vehicle conduits, 43b' and 77', which are attached to the vehicle beneath the truck floor. As shown in FIG. 4, vehicle conduits 43b' and 77' extend from discharge opening 14, underneath the trailer floor 118 to interface 101. Vehicle conduit 77' is connected to perforated tube 22 by airway 102 extending into discharge opening 14. Vehicle conduit 43b' is connected to the space between supplemental membrane 25 and primary membrane 18 by airway 103 extending into discharge opening 14. See FIG. 5.

Interface member 101 provides passageways to the various vehicle conduits connected to the bags of the freight vehicle. FIG. 5 illustrates schematically connections according to the invention to a single bag on a freight vehicle via interface 101. Assembly conduits 77 and 43b are detachably connected to vehicle conduits 77' and 43b', respectively, at interface 101 by any suitable means. Assembly conduits 43b and 77 are preferably constructed of a flexible hose material.

As described above, conduit 77 is a common conduit which branches into conduits 42b and 76b. Conduits 42b, 76b and 43b are connected to blowers 36 and 38 through valve assembly 44 as described above. However, according to this embodiment, valve assembly 44 has two separate valve assembly portions, 44a and 44b.

Valve assembly portion 44a is a fixed base member, and includes a plurality of groups of valve passages 46a, 48a and 52a, each group arranged in a similar array, and each array being aligned in a linear sequence. See FIG. 6. Each array of passages 46a, 48a and 52a is connected to a corresponding set of conduits 42b, 43b and 76b, respectively. Each set of conduits 42b and 76b is connected to common conduit 77, and each set of conduits 77 and 43b is connected to an individual bin 10 through interface 101 as shown in FIG. 5.

According to one aspect of this embodiment, each valve passage 52a of the fixed base member 44a includes a valve gate 56. The valve gates 56 of each array may be interconnected and operate simultaneously under the control of a single valve motor 45 (see FIG. 6) in a similar fashion as described above with reference to utilization of a single valve assembly shown in FIG. 1. Each valve passage 46a of valve assembly portion 44a includes a check valve 54 allowing unidirectional flow of air from blower 36 towards a corresponding bag.

Valve assembly portion 44b is a slidable base member, and is slidably connected to valve assembly portion 44a by track means 105. See FIGS. 6, 7 and 8. The slidable base member 44b includes a single array of valve passages 46b, 48b and 52b, which correspond to and line up with an array 106 of valve passages 46a, 48a and 52a of fixed base member 44a. Valve passages 46b, 48b and 52b are connected to corresponding fan conduits 42a, 43a and 76a respectively. Fan conduits 42a, 43a and 76a are preferably constructed of flexible hose material.

In an alternative embodiment, (see FIG. 5A) slidable base member 44b is provided with a single valve gate 56 controlling fluid passage through valve passage 52b, eliminating the need for valve gates at each valve passage 52a of the fixed base member 44a. A single valve motor, connected to slidable base member 44b, operates the single valve gate to selectively control fluid passage, and travels along track 105 along with slidable base member 44b. According to this embodiment, valve passage 46b of slidable base member 44b includes a single check valve 54 performing the same function as noted above, eliminating the need for check valves at each valve passage 46a of fixed base member 44a.

Figure 6:
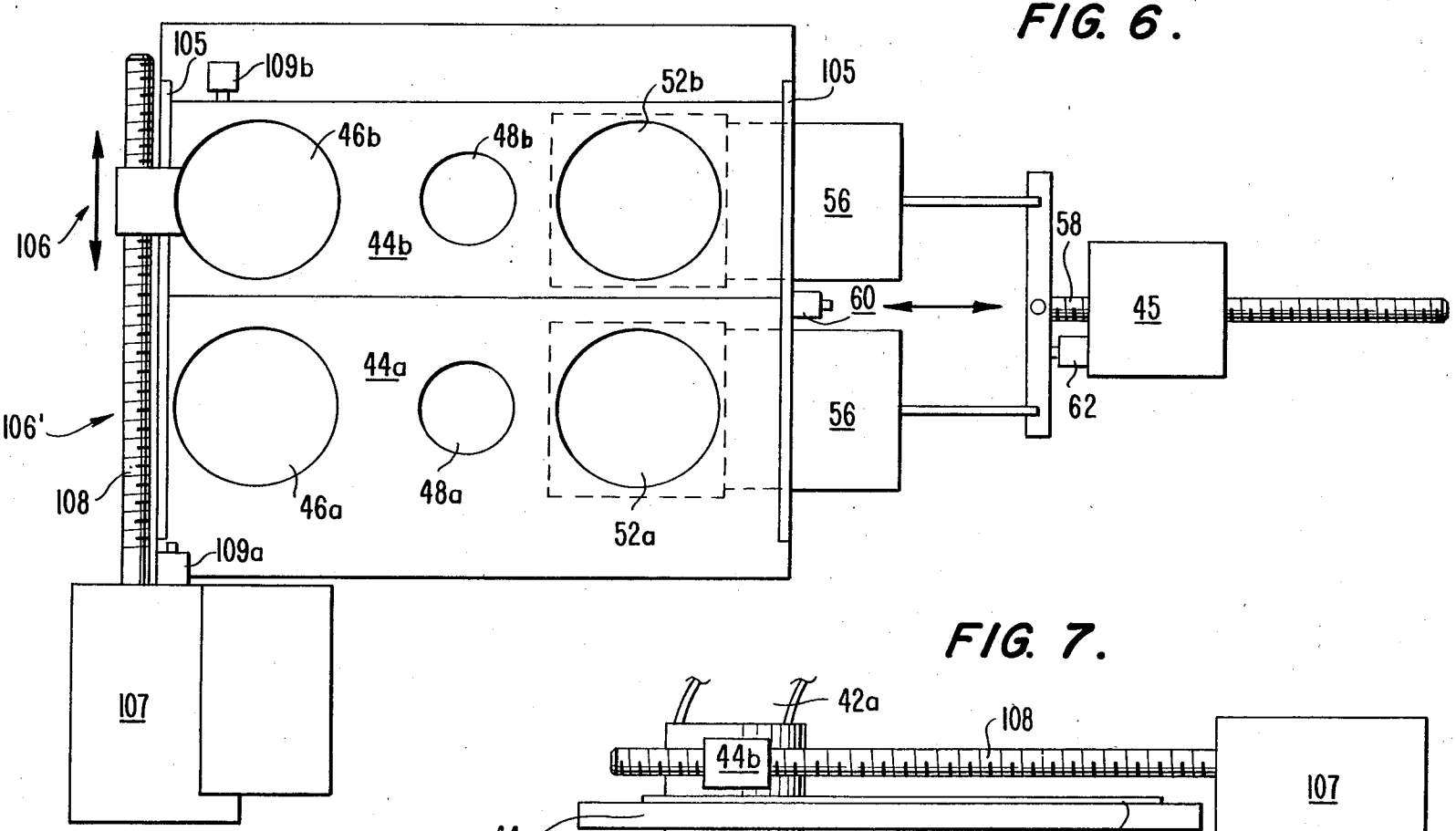
FIG. 6 is a front elevation view of a control valve assembly according to the invention.
Figure 7:
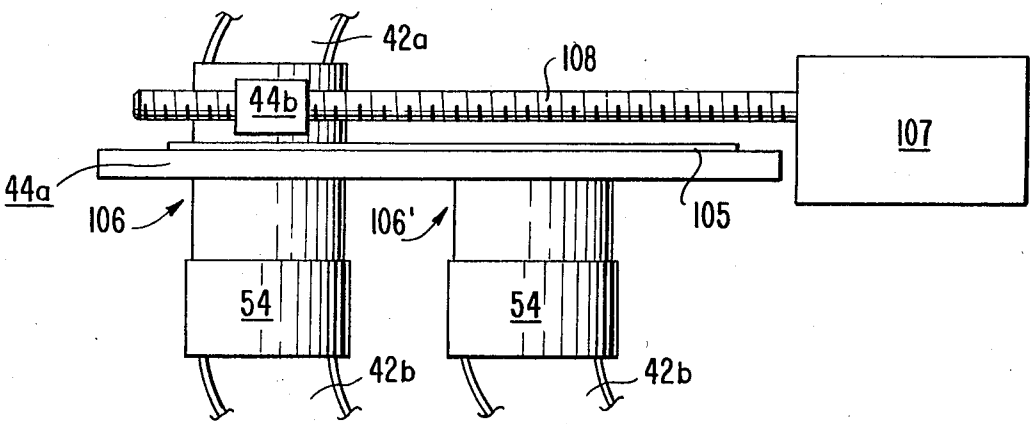
FIG. 7 is a side elevation view of the control valve assembly of FIG. 6.
Figure 8:
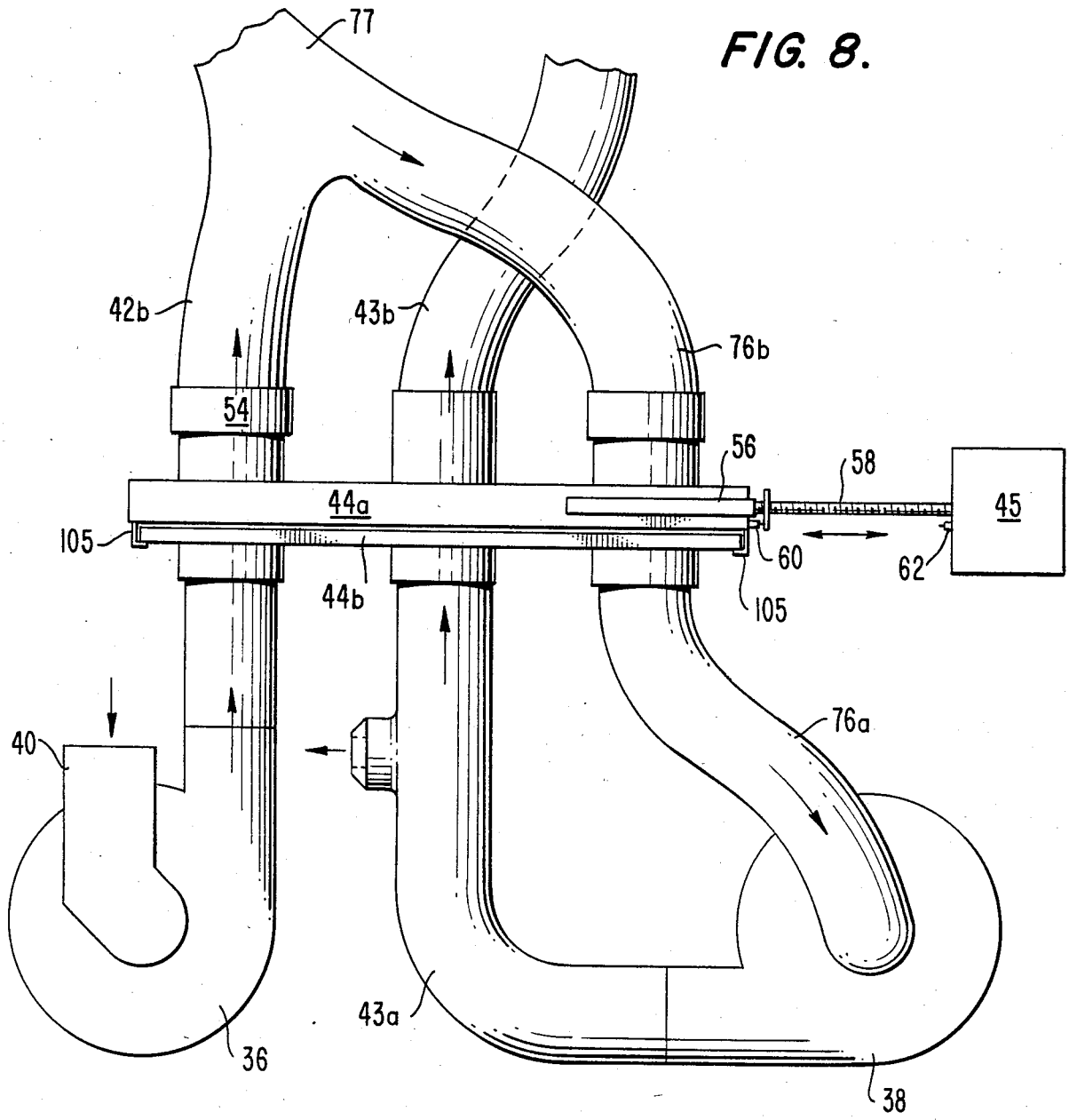
FIG. 8 is a top elevation view of the control valve assembly of FIG. 6.

As shown in FIGS. 6, 7 and 8, slidable base member 44b is in alignment with conduit array 106 connected to fixed base member 44a. In this position, a single bag connected to array 106 may be fully discharged and deflated as described above with reference to FIG. 1.

When a bag is fully deflated and increased vacuum pressure is sensed by sensor 30 at the end of a deflation cycle, deflation blower motor 34 is shut off, valve 56 is closed, and, additionally, coupling motor 107 is activated by the control box. Alternatively, coupling motor 107, blower motor 34 and valve 56 may be controlled by a timer means activated at the beginning of a deflation cycle and set to shut off motor 34, close valve 56 and operate the motor 107 at the end of a discharge cycle. Coupling motor 107 moves the slidable base member 44b along track 105 to a position in alignment with conduit array 106' via screw drive 108 or other suitable means. Limit switch 109a is activated when the slidable base member 44b is brought into alignment with conduit array 106'. Switch 109a through the control box stops motor 107 and triggers the cyclical fluid-assisted discharge of a second bin, connected to conduit array 106' in a similar fashion as described above. Alternatively, coupling motor 107 can be eliminated and the slidable base member 44b may be moved along track 105 manually by an operator.

Completion of the discharge cycle of the second bin activates coupling motor 107, which moves the slidable base member 44b into alignment with conduit array 106 and contact with limit switch 109b. Limit switch 109b shuts down coupling motor 107 through control box 26, leaving the system at rest.

Figure 9:
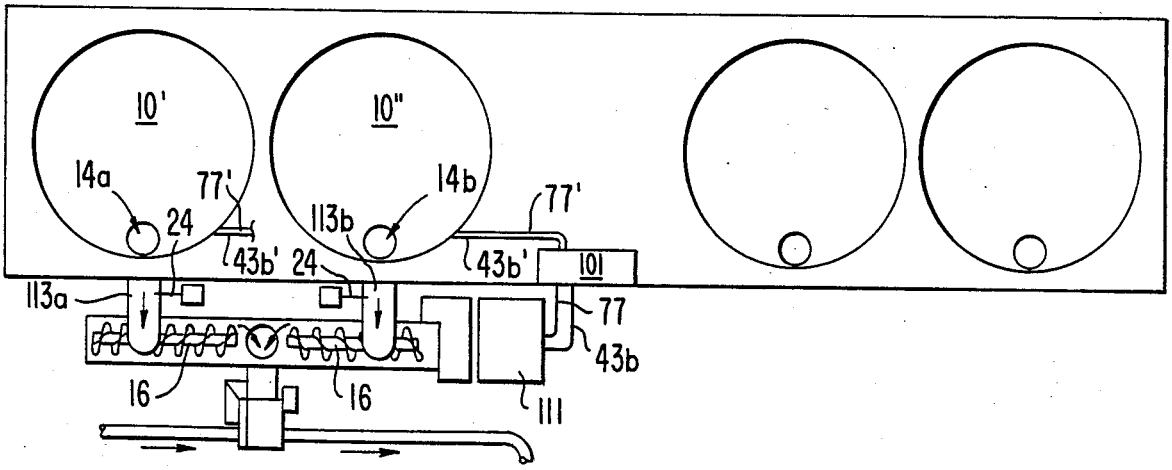
FIG. 9 is a schematic top elevation view of the freight vehicle of claim 2 connected to the valve assembly of FIG. 6 to control the sequential discharge of a pair of bins.

A valve and control assembly as herein described may be utilized to sequentially unload a pair of adjacent bins in a freight vehicle without moving the vehicle. See FIG. 9. The freight vehicle is pulled alongside a discharge station, and two pairs of assembly conduits 43b and 77 are connected to corresponding arrays of vehicle conduits 43b' and 77' at interface 101. Each array of vehicle conduits 43b' and 77' is connected to an individual bin 10' and 10'', and each pair of assembly conduits 43b and 77 are connected to fixed base member 44a as described above. Control box 26, blowers 36 and 38, and valve assembly 44 may all be contained in a single discharge control center 111. Discharge spouts 113a and 113b, connected to discharge openings 14a and 14b are connected to screw conveyor 16. Bags 10' and 10'' are sequentially discharged under the control of discharge control center 111 which is connected to individual material sensing probes 24. After discharge and deflation of the front pair of bags, the vehicle may be pulled up to sequentially discharge the rear pair of bags.

Any number of conduit arrays may be linearly arranged for the sequential discharge of a corresponding number of bags, with slidable base member 44b being brought into alignment with each array in turn for the discharge of individual bags. The slidable base member 44b may be manually aligned with each array of conduits. Alternatively, slidable base member 44b may be provided with an electrical contact positioned to cooperate with an electrical contact at each conduit passage array of fixed base member 44a to control the movement of coupling motor 107 and signal alignment with the arrays for sequential discharge of the bags.

As can be seen, this invention provides a unique, simple, and inexpensive valve assembly and control system for controlling the inflation and deflation cycles of storage bins of the type utilizing inflatable bags. Additionally, however, the valve assembly itself could also be utilized in other environments requiring high-volume, low-pressure flow or other flow characteristics requiring alternate control of fluid paths.

What is claimed is:

1. In a system for handling, storing and discharging flowable granular, powder or flake material, the system being of the type having a generally cup-shaped inflatable bag for storing and discharging the material, said bag including a flexible, inflatable inner primary membrane for assisting in gravity discharge of the material, the material discharging through a discharge opening in the bag, a flexible, inflatable supplemental membrane for discharging material remaining in the bag after inflation of the primary membrane, a first blower means for inflating the bag and a second blower means for deflating the bag, an improved valve and control assembly comprising;

(a) a first outlet conduit connected to the outlet of the first blower means and connected to inflate the bag, the intake of the first blower means in communication with the atmosphere;

(b) an inlet conduit connected to the intake of the second blower means and connected to deflate the bag;

(c) a second outlet conduit connected to the outlet of the second blower means and connected to allow inflation of the supplemental flexible membrane, said second outlet conduit including means for venting to the atmosphere, during or after inflation of the supplemental membrane, excess fluid pressure generated by said second blower means;

(d) a valve assembly including check valve means permitting unidirectional flow of high-volume low-pressure fluid from the first blower means through the first outlet conduit to the bag, second valve means controlling high-volume low-pressure flow of fluid from the bag through the inlet conduit to the second blower means, and passage means allowing flow of fluid from the second blower means through the second outlet conduit to the supplemental membrane.

2. The system of claim 1 further comprising a high-pressure sensing means connected to the interior of the bag, and operable to shut the first blower on detection of excess pressure.

3. The system of claim 1 wherein said first outlet conduit and said inlet conduit are connected to form a common conduit between the inflatable bag and the valve assembly.

4. The system of claim 1 further comprising means operable when the bag is fully inflated or fully deflated for controlling the operation of the blowers and valve means.

5. The system of claim 4 wherein the means operable when the bag is fully inflated includes a limit switch means operable by lifting of the inner primary membrane of the bag at the time the bag is fully inflated.

6. The system of claim 4 wherein the means operable when the bag is fully deflated includes a vacuum sensing means operable to sense increased vacuum in the last stage of deflating the bag.

7. The system of claim 4 wherein the means operable when the bag is fully deflated includes a timer means set to control the operation of the blowers and valve means at the end of a discharge cycle.

8. The system of claim 1 wherein the valve assembly includes a base member having passages therethrough for said conduits, and said second valve means include a slide-operated gate valve supported by the base member and gate valve actuator means for actuating the gate valve for controlling passage of fluid through the inlet conduit.

9. The system of claim 8 wherein the actuator means is a motor-driven screw with means for connecting it to the gate valve for operation.

10. The system of claim 9 further comprising limit switches positioned to be activated by activating means connected to the gate valve when said gate valve reaches the limit of its movement and is either fully opened or fully closed.

11. In a system for discharging granular, powder or flake material from a plurality of cup-shaped inflatable bags for storing and discharging the material, each bag including a flexible, inflatable inner primary membrane for assisting in gravity discharge of the material, the material discharging through a discharge opening in each bag, each bag including a flexible, inflatable supplemental membrane for discharging material remaining in the bag after inflation of the primary membrane, a first blower means for inflating the bags and a second blower means for deflating the bags, an improved valve and control assembly for sequentially discharging the bags, comprising;

(a) a plurality of conduits arranged in a plurality of arrays, the arrays of conduits being arranged in linear sequence, each array of conduits controlling inflation and deflation of a single bag, and each array including:
  (i) a first inflation conduit having one end connected to inflate a bag,
  (ii) a deflation conduit having one end connected to deflate a bag,
  (iii) a second inflation conduit having one end connected to allow fluid passage to and from a supplemental membrane;

(b) a valve assembly positionable to cooperate with each array of conduits, the valve assembly including:
  (i) check valve means permitting unidirectional flow of fluid to a bag through a first inflation conduit to inflate the bag,
  (ii) deflation valve means having open and closed positions, the deflation valve means selectively controlling flow of fluid from a bag through a deflation conduit to deflate the bag,
  (iii) supplemental passage means permitting flow of fluid to or from a supplemental membrane through a second inflation conduit;

(c) a first outlet line connected to the outlet of the first blower means and connected to inflate a bag through said check valve means when the deflation valve means is in the closed position, the intake of the first blower means in communication with the atmosphere;

(d) an inlet line connected to the intake of the second blower means and connected to deflate a bag through said deflation valve means when the deflation valve means is in the open position;

(e) a second outlet line connected to the outlet of the second blower means and connected to allow inflation of a supplemental membrane through said supplemental passage means, the second outlet line including means for venting to the atmosphere, during or after inflation of the supplemental membrane, excess fluid pressure generated by said second blower means.

12. The system of claim 11 further comprising high pressure sensing means in communication with the interior of a bag, and operable to shut off the first blower upon detection of excess pressure in the bag.

13. The system of claim 11 wherein said first outlet conduit and said inlet conduit are connected to form a common conduit between an inflatable bag and the valve assembly.

14. The system of claim 11 further comprising means for sequentially positioning the valve assembly to cooperate with each array of conduits.

15. The system of claim 11 further comprising means operable when a bag is fully inflated or fully deflated for controlling the operation of the blowers and deflation valve means.

16. The system of claim 15 wherein the means operable when a bag is fully inflated includes a first switch means operable by lifting of an inner membrane of a bag at the time the bag is fully inflated.

17. The system of claim 15 wherein the means operable when a bag is fully deflated includes a vacuum sensing means operable to sense increased vacuum in the last stage of deflating the bag.

18. The system of claim 11 wherein additionally, the valve assembly includes a fixed base member which is connected to the conduits and maintains the plurality of conduit arrays in linear sequence, the fixed base member having passages therethrough for said conduits, said valve assembly further including a slidable base member slidably connected to said fixed base member for positioning the valve assembly to cooperate with the conduit arrays, the slidable base member having passages therethrough for said inlet and outlet lines.

19. The system of claim 18 further comprising slidable base member actuator means for actuating the slidable base member and sequentially positioning the slidable base member to cooperate with the conduit arrays.

20. The system of claim 18 wherein said check valve means and said deflation valve means are supported by said slidable base member.

21. The system of claim 18 wherein each array of conduits is provided with separate check valve means and deflation valve means, and wherein said check valve means and said deflation valve means are supported by said fixed base member.

22. The system of claim 18 wherein said deflation valve means includse a slide-operated gate valve supported by the valve assembly and gate valve actuator means for actuating the gate valve for controlling passage of fluid through an inlet conduit.

23. The system of claim 22 wherein the actuator means is a motor-driven screw with means connecting it to the gate valve for operation.

24. The system of claim 23 further comprising limit switches positioned to be activated by activating means connected to the gate valve when said gate valve reaches the limit of its movement and is either fully opened or fully closed.

25. The system of claim 24 further comprising slidable base member actuator means for actuating the slidable base member and sequentially positioning the slidable base member to cooperate with the conduit arrays.

26. The system of claim 25 wherein the slidable base member actuator means is a motor-driven screw with means connecting it to the slidable base member.

27. The system of claim 26 for the sequential discharge of a pair of bags, wherein said plruality of conduit arrays comprises a first and a second conduit array.

28. The system of claim 27 further comprising limit switches positioned to be activated by activating means connected to the slidable base member when said slidable base member reaches the limit of its movement, and is either positioned to cooperate with said first conduit array or positioned to cooperate with said second conduit array.

29. The system of claim 28 further comprising means operable when a bag is fully inflated or fully deflated for controlling the operation of the blowers and deflation valve means, said means operable when a bag is fully deflated also comprising means operable for controlling movement of the slidable base member from a position in cooperation with one conduit array to a position in cooperation with another conduit array.

30. The system of claim 29 wherein the means operable when a bag is fully inflated includes a first switch means operable by lifting of an inner membrane of a bag at the time the bag is fully inflated.

31. The system of claim 29 wherein the means operable when a bag is fully deflated includes a vacuum sensing means operable to sense increased vacuum in the last stage of deflating the bag.

32. The system of claim 29 wherein the means operable when a bag is fully deflated includes a timer means set to control the operation of the blowers, deflation valve means and the slidable base member at the end of a discharge cycle.

33. The system of claim 28 wherein said pair of bins are located on a freight vehicle, said first outlet conduit and said inlet conduit are connected to form a common conduit between an inflatable bag and the valve assembly, said common conduit including a vehicle common conduit and an assembly common conduit, said vehicle common conduit being attached to the freight vehicle and having one end connected to inflate or deflate a primary membrane and the other end detachably connected to one end of the assembly common conduit by means of common conduit detachable connecting means, the other end of the assembly common conduit being connected to said first outlet conduit and said inlet conduit; and said second outlet conduit including a vehicle outlet conduit and an assembly outlet conduit, said vehicle outlet conduit being attached to the freight vehicle and having one end connected to inflate and deflate the supplemental membrane and the other end detachably connected to one end of the assembly outlet conduit by means of outlet conduit detachable connecting means, the other end of the assembly outlet conduit being connected to said supplemental passage means of said valve assembly.

34. The system of claim 33 wherein said check valve means and said deflation valve means are supported by said slidable base member.

35. The system of claim 33 wherein each array of conduits is provided with separate check valve means and deflation valve means, and wherein said check valve means and said deflation valve means are supported by said fixed base member.

36. The system of claim 33 wherein said freight vehicle has a flat floor, and said vehicle common conduit and vehicle outlet conduit are attached to the freight vehicle beneath said floor.

* * * * *